US006432590B1

(12) United States Patent
Ueda et al.

(10) Patent No.: US 6,432,590 B1
(45) Date of Patent: Aug. 13, 2002

(54) ELECTROPHOTOGRAPHIC TONER AND IMAGE FORMING METHOD USING THE TONER

(75) Inventors: Hideyuki Ueda; Shohichi Sugimoto; Satoru Miyamoto; Osamu Uchinokura; Kumi Hasegawa; Tamotsu Kajihara; Yoshihiro Suguro; Noboru Kuroda, all of Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/709,352

(22) Filed: Nov. 13, 2000

(30) Foreign Application Priority Data

Nov. 12, 1999 (JP) ..... 11-323225

(51) Int. Cl.[7] ..... G03G 9/00

(52) U.S. Cl. ..... 430/18; 430/110.3; 430/137.18; 430/137.2

(58) Field of Search ..... 430/18, 110.3, 430/137.18, 137.2

(56) References Cited

U.S. PATENT DOCUMENTS

| | | | | |
|---|---|---|---|---|
| 5,380,616 A | | 1/1995 | Aoki et al. | 430/110 |
| 5,510,222 A | * | 4/1996 | Inabe et al. | 430/108.5 |
| 5,565,298 A | | 10/1996 | Suguro et al. | 430/137 |
| 5,747,213 A | * | 5/1998 | Okado et al. | 430/108.8 |
| 5,840,456 A | | 11/1998 | Tomita et al. | 430/106 |
| 5,858,596 A | * | 1/1999 | Tajima et al. | 430/108.8 |
| 5,882,832 A | | 3/1999 | Tosaka et al. | 430/106 |
| 5,935,751 A | * | 8/1999 | Matsuoka et al. | 430/108.8 |
| 5,998,074 A | | 12/1999 | Miyamoto et al. | 430/106 |
| 6,074,795 A | | 6/2000 | Watanabe et al. | 430/109 |
| 6,103,439 A | * | 8/2000 | Ogawa et al. | 430/110.3 |

FOREIGN PATENT DOCUMENTS

| | | |
|---|---|---|
| JP | 03243956 A | 10/1991 |
| JP | 03296067 A | 12/1991 |
| JP | 05045924 A | 2/1993 |
| JP | 05197199 A | 8/1993 |
| JP | 07271095 A | 10/1995 |
| JP | 07301951 A | 11/1995 |

* cited by examiner

*Primary Examiner*—Mark Chapman
(74) *Attorney, Agent, or Firm*—Oblon, Spivak, McClelland, Maier & Neustadt, P.C.

(57) ABSTRACT

A toner including toner particles including at least a binder resin having a first melting point and a first solubility parameter, a colorant and a particulate release agent having a second melting point lower than the first melting point and a second solubility parameter different from the first solubility parameter, wherein the particulate release agent dispersed in the toner particles has an average needle-shape degree LD/SD of not less than 1.6, where LD is a diameter of a particle of the release agent dispersed in the toner in a major axis direction thereof and SD is a diameter of the particle in a minor axis direction.

34 Claims, 2 Drawing Sheets

ELECTROPHOTOGRAPHIC TONER AND IMAGE FORMING METHOD USING THE TONER

BACKGROUND OF THE INVENTION

1. Field of the Invention

The present invention relates to an electrophotographic toner for developing an electrostatic latent image formed in an electrophotographic image forming apparatus such as copiers, printers and facsimiles. Particularly, the present invention relates to an electrophotographic toner useful for an image forming apparatus using an intermediate transfer medium. In addition, the present invention relates to an image forming method using the toner.

2. Discussion of the Background

Electrophotographic image forming methods and apparatus using an intermediate transfer medium are well known. In the image forming methods and apparatus, the following image forming steps are typically performed:

(1) a visible image (i.e., a toner image) formed on an image bearing member is transferred on an endless intermediate transfer medium (first image transfer step);

(2) repeating the first image transfer step a plurality of times using different color toners, i.e., another toner image formed on the image bearing material is then transferred on the intermediate transfer medium on which the first image has been formed (another first image transfer step), if desired;

(3) the toner images transferred on the intermediate transfer medium are transferred on a receiving material to form a monochrome or color toner image on the receiving material (second image transfer step); and (4) the toner image formed on the receiving material is fixed to form an image (fixing step).

In such image forming methods and apparatus, a problem which occurs is that the resultant toner image formed on a receiving material often has local image omission which is caused by image omission in the first and/or second transfer step. When such image omission occurs in a solid image, the image omission is observed as a white image having a certain area. When such image omission occurs in a solid line image, the solid line image is observed as a cut line.

In order to avoid such an image omission problem by improving the toner used, the following methods have been proposed:

(1) the fluidity of the toner is enhanced to improve the transferability of the toner in the first and/or second image transfer steps; and (2) a particulate resin is added to the toner to avoid an aggregation problem of the toner when the toner is pressed in the first and second toner transfer step.

On the other hand, in attempting to avoid an offset problem in which a toner image on a receiving sheet adheres to a fixing roller when the toner image is fixed and the toner image is re-transferred on the receiving sheet and/or another receiving sheet, a method in which a silicone oil or a fluorine-containing oil is applied to the surface of the fixing roller constituted of a release material, such as silicone rubbers and fluorine-containing resins, to cover the surface of the fixing roller with the oil is typically performed. This method is effective for avoiding the offset problem, however, the method has a drawback such that the image forming apparatus becomes large in size because the apparatus has to have a device for supplying the oil to the fixing roller. In addition, this method has another drawback such that the life of the fixing roller is shortened because the oil causes peeling of the layers constituting the fixing roller.

In attempting to avoid such an offset problem without using such an oil supplying device, a technique in which a release agent such as low-molecular weight polyethylene and polypropylene is added to a toner to impart releasability to the toner when the toner is fixed is proposed.

However, the technique has a drawback such that the fluidity of the resultant toner deteriorates and thereby a film tends to form on the intermediate transfer medium, resulting in formation of image omission in the resultant toner image. In addition, other problems such that image density of the resultant toner image deteriorates, and toner adheres to a background area of an image, i.e., background development occurs.

In attempting to avoid such a filming problem (i.e., to improve the fluidity of a toner), the following techniques have been proposed:

(1) Japanese Laid-Open Patent Publication No. 3-243956 discloses a toner which has an average lattice length of primary peaks at low X-ray diffraction angles of from 200 to 5,000 Å;

(2) Japanese Laid-Open Patent Publication No. 3-296067 discloses a toner in which a binder polymer and a polypropylene constitute an island-sea state, wherein the maximum value of the major axis of the island state which is formed by the polypropylene is from 200 to 3,000 Å, and the average interval between an island and the adjacent island is not greater than 1 $\mu$m;

(3) Japanese Laid-Open Patent Publication No. 5-45924 discloses a toner in which a release agent, which has a melting point of from 60 to 180° C. and in which the difference between the melt starting temperature and the melt completing temperature is not greater than 50° C., is formed on the toner in a thickness of from 100 to 5,000 Å;

(4) Japanese Laid-Open Patent Publication No. 5-197199 discloses a toner in which a particulate polyolefin having a diameter of from 0.01 to 0.5 $\mu$m is dispersed on the surface of the toner, wherein the concentration of the polyolefin in the toner is from 2 to 20% by weight (the toner is also intended to retain good-developing property and not to abrade a photoreceptor);

(5) Japanese Laid-Open Patent Publication No. 7-301951 discloses a toner which includes a binder resin and a release agent, wherein the difference in solubility parameter between the binder resin and the release agent is not greater than 1.5; and (6) Japanese Laid-Open Patent Publication No. 7-271095 discloses a toner having a crystallinity of from 40 to 60% However, the techniques of (1), (2) and (3) mentioned above cannot perfectly avoid the adhesion of the release agent to the intermediate transfer medium.

In the technique (4), fine holes are formed on the surface of the toner using a particulate inorganic material to retain a release agent therein. Thus, the size of the dispersed release agent is controlled. To impart good releasability to the toner, the inorganic material has to be added in a relatively large amount, resulting in peeling of the inorganic material from the toner. The peeled inorganic material tends to adheres to an image bearing member, resulting in formation of black spots on the resultant toner image.

In the technique (5), the binder resin and the release agent mix compatibly and therefore the offset problem cannot be solved. In the technique (6), the filming of the release agent cannot be avoided when the dispersion of the release agent is insufficient.

Because of these reasons, a need exists for a toner which can produce good toner images without causing image defects such as image omission, decrease of image density and background development.

SUMMARY OF THE INVENTION

Accordingly, an object of the present invention is to provide a toner which can produce good toner images without causing image defects such as image omission, decrease of image density and background development.

Briefly the object and other objects of the present invention as hereinafter will become more readily apparent can be attained by a toner which includes toner particles including at least a binder resin having a first melting point and a first solubility parameter, a colorant, and a particulate release agent having a second melting point lower than the first melting point and a second solubility parameter different from the first solubility parameter, wherein the particulate release agent has an average needle-shape degree LD/SD of not less than 1.6, where LD is a diameter of a particle of the release agent dispersed in the toner in a major axis direction thereof and SD is a diameter of the particle in a minor axis direction.

Preferably, 75% by number or more of the particulate release agent included in the toner particles has a needle-shape degree not less than 2.0. In addition, 75% by number or more of the particulate release agent included in the toner particles preferably has an equivalent spherical particle diameter not greater than 1 $\mu$m when it is assumed that the particulate release agent has a spherical shape.

Further, the melting point of the release agent is preferably from 65 to 100° C., and the difference in solubility parameter between the binder resin and the release agent is preferably not less than 1.0. Such a release agent is preferably present in the toner in an amount of from 1 to 10% by weight.

Furthermore, the release agent preferably includes two or more release materials having a different solubility parameter and melting point.

In another aspect of the present invention, an image forming method is provided which includes the steps of forming a toner image on an image bearing member; first transferring the toner image on an intermediate transfer medium; optionally repeating the image forming and first transferring steps one or more times to form a color image on the intermediate transfer medium; and second transferring the toner image on the intermediate transfer medium to a receiving material, wherein the toner or toners are the toner of the present invention mentioned above. The second transferring step can be eliminated, i.e., the toner image on the image bearing member may be directly transferred onto the receiving material.

In yet another aspect of the present invention, a method for manufacturing a toner is provided which includes the steps of kneading a mixture of a binder resin having a first melting point and a first solubility parameter, a colorant, and a release agent having a second melting point lower than the first melting point and a second solubility parameter different from the first solubility parameter at a temperature not higher than a temperature higher than the first melting point by 20° C. and higher than the second melting point using a kneader to prepare a mixture; subjecting the mixture to a cooling treatment; pulverizing the mixture; and optionally adding an external additive to the pulverized mixture to form a toner. The interval between the kneading step and the cooling step is not longer than 60 seconds.

These and other objects, features and advantages of the present invention will become apparent upon consideration of the following description of the preferred embodiments of the present invention taken in conjunction with the accompanying drawings.

BRIEF DESCRIPTION OF THE DRAWING

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
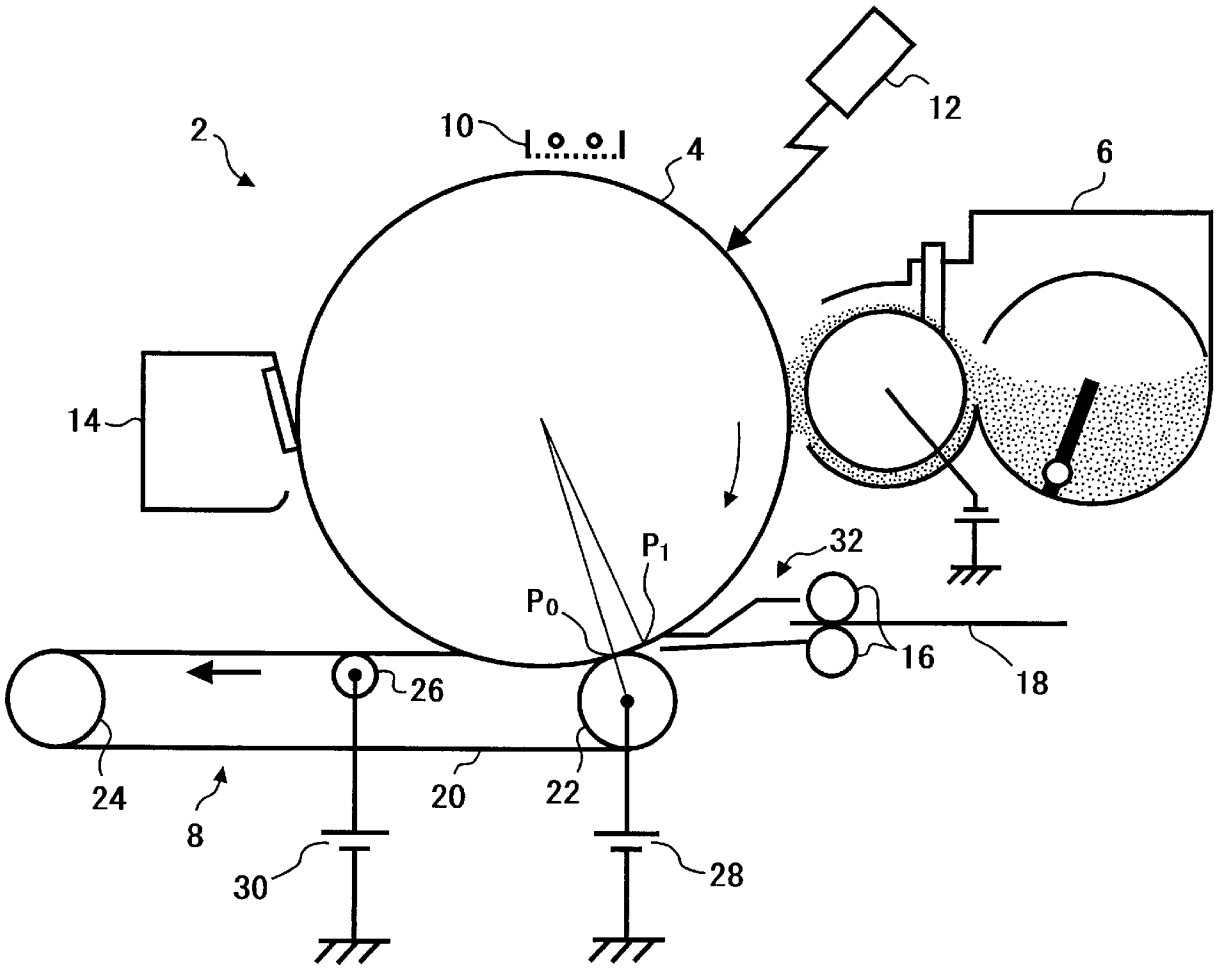
FIG. 1 is a schematic view illustrating the main part of an image forming apparatus for use in the electrophotographic image forming method of the present invention.

The present inventors discover that the filming problem and deterioration of fluidity of a toner mainly depend on the release agent included in the toner. Namely it is discovered that when the release agent dispersed in the toner has a relatively small particle diameter and a needle-like flat shape whereas conventional toners include a release agent having a nearly spherical shape, the filming problem can be dramatically improved.

The toner of the present invention is typically prepared by the following processes:

(1) toner constituents such as a binder resin, a colorant, a charge controlling agent and a release agent are mixed and then kneaded upon application of heat using a kneader;

(2) the kneaded mixture is cooled and then crushed using a crusher;

(3) the mixture is pulverized using a pulverizer and then classified using an air classifier to prepare a mother toner; and (4) an external additive is added to the mother toner, if desired, to prepare a toner.

In order to prepare the toner of the present invention in which a release agent having a needle-like flat shape is dispersed, the kneading temperature in the kneading process is preferably controlled at a temperature which is higher than the melting point of the release agent and which is not higher than the temperature higher than the melting point of the binder resin by 20° C.

The reason why the thus prepared toner has good properties is considered to be as follows. In the kneading process, the release agent melts and achieves a liquid state having low viscosity. On the other hand, the binder resin, which is heated at a temperature around the melting point thereof, has a relatively high viscosity. When such a mixture is mixed using a continuous kneader, the mixture is kneaded and fed while a tension is repeatedly applied the mixture along the flowing direction thereof. Therefore, the release agent in the mixture tends to be deformed so as to have a needle-like shape and arranged along the flowing direction.

When the kneading temperature is higher than the melting point of the binder resin by 20° C. or more, the release agent is not only uniformly dispersed in the mixture, but also has a spherical shape. This is because the viscosity of the melted mixture is relatively low and therefore the melted release agent deforms such that the interfacial energy is minimized (i.e., such that its surface area is minimized). Therefore, the release agent has a nearly spherical shape.

When the kneading temperature is lower than the melting point of the release agent, the mixture cannot be kneaded because the mixture does not melt.

Suitable kneaders for use in the present invention include continuously-processing two-axis extruders such as KTK-type two-axis extruders manufactured by Kobe Steel, Ltd., TEM-type two-axis extruders manufactured by Toshiba Machine Co., Ltd., two-axis extruders manufactured by KCK Co., two-axis extruders manufactured by Ikegai Corporation, and KEX-type two-axis extruders manufactured by Kurimoto, Ltd.; and continuously-processing single-axis extruders such as KO-KNEADER manufactured by Buss AG.

It is difficult to prepare the toner of the present invention, in which a release agent having a needle-like flat shape is dispersed, by using batch-processing two-roll mills, and Banburry's mixer.

It is preferable for effectively preparing the toner of the present invention that the kneaded mixture is rapidly cooled after the mixture is discharged from a kneader. Specifically, the kneaded mixture is preferably cooled at a temperature lower than the melting point of the release agent within 60 seconds, and preferably within 20 seconds just after the mixture is discharged from a kneader. In the thus prepared toner, the release agent is dispersed while keeping the needle-like shape.

When the kneaded mixture is not rapidly cooled (i.e., the mixture is preserved at a relatively high temperature such that the binder resin and release agent melt) for a time longer than 60 seconds, the release agent changes its needle-like shape to a nearly spherical shape. In addition, particles of the release agent tend to aggregate, resulting in formation of large spherical particles of the release agent. Therefore, a toner having desired properties cannot be obtained.

In the above-description, the temperature of the kneaded mixture is the temperature of the inside of the mixture just discharged from the kneader, which is measured with a thermocouple type thermometer. The temperature of the cooled mixture is the temperature of the surface of the mixture after subjected to a roll cooling treatment, which is also measured by a thermocouple type thermometer.

The methods for determining the shape of a release agent dispersed in a toner are, for example, as follows:

Dissolving Method (1) the toner is dissolved and dispersed in a solvent by which the release agent cannot be dissolved and the binder resin can be dissolved;

(2) the dispersion liquid is observed with a transmission optical microscope to determine the shape of the release agent dispersed in the liquid.

Direct Method (1) a toner particle or toner block is cut to prepare a thin film; and (2) the thin film is observed with a transmission optical microscope to determine the shape of the release agent dispersed in the thin film.

In the toner of the present invention, the dispersed release agent preferably has a large needle-shape degree, wherein the needle-shape degree is defined as the ratio of the diameter of a particulate release agent dispersed in the toner in a major axis direction thereof to the diameter thereof in a minor axis direction, to prevent the release agent from releasing from the toner or to avoid filming of the release agent on an intermediate transfer medium.

Specifically, in the toner of the present invention, the release agent dispersed in the toner preferably satisfies the following relationship:

$$LD/SD \geqq 1.6$$

wherein LD represents a diameter of a particle of the release agent dispersed in the toner in a major axis direction thereof; and SD represents a diameter of the particle in a minor axis direction.

The ratio (hereinafter referred to as a needle-shape degree)is more preferably not less than 2, and even more preferably from 3 to 10. When the ratio is from 1.0 to 1.5, the effects mentioned above are hardly exerted.

The needle-shape degrees of several particles of the release agent dispersed in a toner are measured to obtain an average needle-shape degree. In the present invention, the particulate release agent preferably has an average needle-shape degree not less than 1.6.

Especially, it is preferable for the toner of the present invention that 75% by number or more of the release agent particles dispersed in the toner have a needle-shape degree not less than 2 to effectively exert the effects mentioned above.

In addition, in the toner of the present invention the particulate release agent dispersed therein preferably has an average equivalent spherical particle diameter not greater than 1 $\mu$m. At this point, the method for measuring the sphere-equivalent particle diameter of a particle is as follows:

(1) the shape of a particulate release agent dispersed in a toner is observed by the dissolving method mentioned above; and (2) the image of the particulate release agent observed by an optical microscope is subjected to an image processing treatment to determine the equivalent spherical particle diameter.

The equivalent spherical particle diameter can be determined as the diameter of a circle having the same area as the ellipsoid shape of the release agent dispersed in the liquid.

The average equivalent spherical particle diameter is obtained by averaging the equivalent spherical particle diameters of a plurality of particles.

When the average equivalent spherical particle diameter is greater than 1 $\mu$m, the release agent tends to present at the surface part of the toner, resulting in occurrence of the problem such that the release agent releases from the toner and the problem such that a film of the release agent is formed on an intermediate transfer medium. In addition, since the release agent is unevenly dispersed in the toner, the quality of the toner is not stable.

In order to prepare the toner in which the release agent is dispersed therein such that the release agent particles dispersed in the toner have an average equivalent spherical article diameter not greater than 1 $\mu$m, and 75% by number or ore of the release agent particles have a needle-shape degree to less than 2, it is preferable that the kneading temperature is controlled so as to be as low as possible within the preferable range while applying high shear strength to the mixture to be kneaded.

Further, in the toner of the present invention it is preferable that the difference in solubility parameter between the release agent used and the binder resin used is not less than 1. When the difference in solubility parameter is less than 1, the binder resin and release agent tend to be uniformly mixed when kneaded. Therefore, the release agent does not melt at its original melting point, and thereby the effects of the release agent are hardly exerted. When the difference is not less than 1, the release agent tends to achieve a particulate state in the toner (namely, the release agent is present in the toner while forming domains), the effects can be exerted.

In the toner of the present invention, the release agent preferably has a melting point of from 65 to 100° C., and the concentration of the release agent in the toner is preferably from 1 to 10% by weight. When the concentration is less than 1% by weight, the releasing effect cannot be exerted. On the contrary, when the concentration is greater than 10%, the viscosity of the mixture to be kneaded becomes too low. Therefore, a toner having good performance cannot be prepared because shear strength cannot be applied to the mixture in the kneading process.

In the present invention, a plurality of release agents, which have different solubility parameters, can be included in the toner, although the effects of the release agent can be exerted when only one release agent is included in the toner. By including in a toner a first release agent which has a relatively low melting point and a second release agent which has a relatively high melting point and which has a solubility parameter different from that of the first release agent, fixable temperature range of the toner within which a toner image can be fixed without causing an offset problem can be further widened. This is because the first release agent mainly bleeds out of the toner when the toner image is fixed at a relatively low fixing temperature, and the second release agent mainly bleeds out of the toner when the toner image is fixed at a relatively high fixing temperature.

In the present invention, the melting points of the binder resin, kneaded mixture and toner are measured with a flow tester (tradenamed as CFR-500 manufactured by Shimazu Corp). The measuring conditions are as follows:

Diameter of die: 0.5 mm

Pressure applied to the sample to be measured: 10 kg/cm$^2$

Temperature rising speed: 3° C./min

The melting point is defined as the flow-starting temperature.

The melting point of the release agent is measured with Rigaku Thermoflex TG8110 manufactured by Rigaku Co., Ltd. The temperature rising speed is 10° C./min. The melting point is defined as the temperature at which a maximum peak of an endothermic reaction is observed.

In addition, the solubility parameter is determined using a dissolving method.

As the binder resin for use in the toner of the present invention, known resins for use in the conventional toners can be used. However, it is preferable to use a vinyl resin, a polyester resin and/or a polyol resin.

Suitable vinyl resins for use in the toner of the present invention include styrene polymers and substituted styrene polymers such as polystyrene, poly-p-chlorostyrene, polyvinyltoluene and the like; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers and the like; and other resins such as polymethyl methacrylate, polybutyl methacrylate, polyvinyl chloride, polyvinyl acetate, and the like. These resins are used alone or in combination.

Suitable polyester resins for use as the binder resin of the toner of the present invention include polyester resins which are reaction products of one or more of the dihydric alcohols with one or more of the dibasic acids, optionally using a third component such as polyhydric alcohols and polycarboxylic acids.

Specific examples of the dihydric alcohols include ethylene glycol, triethylene glycol, 1,2-propylene glycol, 1,3-propylene glycol, 1,4-butanediol, neopentyl glycol, 1,4-butenediol, 1,4-bis (hydroxymethyl) cyclohexane, bisphenol A, hydrogenated bisphenol A, polyoxyethylenated bisphenol A, polyoxypropylene(2,2) -2,2'-bis(4-hydroxyphenyl) propane, polyoxypropylene(3,3)-2,2-bis(4-hydroxyphenyl) propane, polyoxyethylene(2,0)-2,2-bis(4-hydroxyphenyl) propane, polyoxypropylene(2,0)-2,2'-bis(4-hydroxyphenyl) propane, and the like compounds.

Specific examples of the dibasic acids include maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, and linoleinic acid, and anhydrides of these acids and esters of these acids with lower alcohols.

Specific examples of the alcohols having three or more hydroxyl groups include glycerin, trimethylol propane, pentaerythritol, and the like compounds. Specific examples of the acids having three or more carboxyl groups include trimellitic acid, pyromellitic acid, and the like compounds.

Specific examples of the polyol resins include reaction products of an epoxy resin; one of adducts of a dihydric phenol compound with an alkylene oxide or their glycidyl ethers; a compound having an active hydrogen atom capable of reacting with an epoxy group; and a compound having two or more active hydrogen atoms capable of reacting with epoxy groups.

Other resins may be added to the toner of the present invention. Specific examples of the other resins include epoxy resins, polyamide resins, urethane resins, phenolic resins, butyral resins, rosin, modified rosins, terpene resins and the like resins. Specific examples of such epoxy resins include polycondensation products of a bisphenol such as bisphenol A and bisphenol F with epichlorohydrin.

Specific examples of the release agent for use in the toner of the present invention include natural waxes such as candelilla wax, carnauba wax, and rice wax; montan wax, paraffin waxes, sazol wax, low-molecular polyethylene, low-molecular polypropylene, alkylphosphoric acid esters, and the like compounds. The release agent is selected from these materials while considering the binder resin used and the material of the fixing roller.

The release agent for use in the toner of the present invention preferably has a melting point of from 65 to 100° C. to avoid blocking problem of the resultant toner and to avoid an offset problem in which toner images formed on a receiving material adhere to a fixing roller when the temperature of the fixing roller is relatively low, and the image is then re-transferred to the receiving material and/or another receiving material.

As the colorant in the toner of the present invention, known dyes and pigments can be used. Specific examples of such dyes and pigments represented by Color Index include C.I. Solvent Blue 22, 63, 78, 83–86, 91, 94, 95 and 104; C.I. Solvent Yellow 6, 9, 17, 31, 35, 100, 102, 103 and 105; C.I. Solvent Orange 2, 7, 13, 14, and 66; C.I. Solvent Red 5, 16, 17, 18, 19, 22, 23, 143, 145, 146, 149, 150, 151, 157 and 158; C.I. Solvent Green 24 and 25; and C.I. Solvent Brown 3 and 9.

Specific examples of tradenamed dyes and pigments include the following dyes.

SOT-series Dyes Manufactured by HODOGAYA CHEMICAL CO., LTD.

Yellow 1, 3 and 4; Orange 1, 2 and 3; Scarlet 1; Red 1, 2 and 3; Brown 2; Blue 1 and 2; Violet 1, Green 1, 2 and 3; and Black 1, 4, 6 and 8.

Sudan-series Dyes Manufactured by BASF

Yellow 146 and 150; Orange 220; Red 290, 380 and 460; and Blue 670.

Diaresin-series Dyes Manufactured by Mitsubishi Chemical Corp.

Yellow 3G, F, H2G, HG, HC and HL; Orange HS and G; Red GG, S, HS, A, K and H5B; Violet D; Blue J, G, N, K, P, H3G and 4G; Green C; and Brown A.

Oilcolor-series Dyes Manufactured by Orient Chemical Industries Co., Ltd.

Yellow 3G, GS-S and #502; Blue BOS and 11N; and Black HBB, #803, EB and EX.

Sumiplast-series Dyes Manufactured by Sumitomo Chemical Co. Ltd.

Blue GP and OR; Red FB and 3B; and Yellow FL7G and GC.

Dyes Manufactured by Nippon Kayaku Co., Ltd.

Kayaron Polyester Black EX-SF300; Kayaset Red B; and Kayaset Blue A-2R.

Specific examples of the pigment for use as the colorant of the toner of the present invention include inorganic pigments such as chrome yellow, zinc yellow, barium yellow, cadmium yellow, zinc sulfide, antimony white, cadmium red, barium sulfate, lead sulfate, strontium sulfate, zinc oxide, titanium white, red iron oxide, iron black, chromium oxide, aluminum hydroxide, calcium silicate, ultramarine, calcium carbonate, magnesium carbonate, carbon black, graphite, aluminum powder, and bronze powder; and organic pigments such as Madder Lake, Logwood Lake, cochineal lake, Naphthol Green B, Naphthol Green Y, Naphthol Yellow S, Lithol Fast Yellow 2G, Permanent Red 4R, Brilliant Fast Scarlet, Hansa Yellow, Lithol Red, Lake Red D, brilliant Carmine 6B, Permanent Red F5R, Pigment Scarlet 3B, Bordeaux 10B, Phthalocyanine Blue, Phthalocyanine Green, Sky Blue, Rhodamine Lake, Malachite Green Lake, Eosin Lake, Quinoline Yellow Lake, Indanthrene Blue, Thioindigo maroon, Alizarine Lake, quinacridone red, quinacridone violet, perynone red, perynone scarlet, isoindolinone yellow, dioxane violet, and Aniline Black.

These dyes and pigments can be employed alone or in combination. The concentration of the colorant in the toner is preferably from 1 to 20% by weight.

In the present invention, it is preferable to include a charge controlling agent in the toner to prepare a toner having a constant charge quantity. As the charge controlling agent, known charge controlling agents can be used. Specific examples of positive charge controlling agents include quaternary ammonium salts, metal complexes and salts of imidazole and the like compounds. Specific examples of negative charge controlling agents include metal complexes and salts of salicylic acid, organic boron-containing salts, calixarene compounds and the like.

In the present invention, the kneaded mixture including toner constituents is crushed with a crusher such as hammer mills and the like after the kneaded mixture is rapidly cooled. The crushed mixture is then pulverized with a pulverizer such as pulverizers using jet air. In the crushing process, the mixture is preferably pulverized so as to have an average particle diameter of from 3 to 15 $\mu$m. In addition, the pulverized mixture is preferably classified so that the particle diameter of the resultant mother toner particles falls into a range of from 5 to 20 $\mu$m.

The thus prepared mother toner is mixed with one or more external additives, if desired. As the external additives, preservability/fluidity imparting agents, cleaning agents and the like are exemplified.

Specific examples of the preservability/fluidity imparting agents include silica, aluminum oxide, titanium dioxide, zinc oxide and the like powders. Specific examples of the cleaning agents include long-chain fatty acids such as stearic acid, and esters, amides and metal salts of the long-chain fatty acids; and particulate resins such as fluorine-containing resins, acrylic resins and the like resins.

The toner of the present invention may be used as a one component developer which includes only a toner or for a two component developer which includes a toner and a carrier.

When the toner of the present invention is used for a two component developer, the carrier material preferably has an average particle diameter not greater than 500 $\mu$m. Suitable materials for use as the carrier include known carrier materials such as powders of iron, nickel, cobalt, and iron oxides; and glass beads and particulate silicone resins. The carrier materials may be coated with one or more resins such as fluorine-containing resins, acrylic resins, silicone resins and the like resins.

Next, the image forming method of the present invention will be explained referring to FIG. 1.

FIG. 1 is a schematic view illustrating a main part of an image forming apparatus 2 useful for the electrophotographic image forming method of the present invention. The image forming apparatus 2 includes a photoreceptor 4, a developing unit 6, and a transfer belt 8. Around the photoreceptor 4, a charger 10, a light irradiation device 12, and a cleaning device 14 are provided in order in a direction indicated by an arrow (i.e., in a rotation direction of the photoreceptor). The surface of the photoreceptor 4 is uniformly charged with the charger 10. The light irradiation device 12 irradiates the charge photoreceptor 4 with imagewise light to form an electrostatic latent image on the surface of the photoreceptor 4. The electrostatic latent image is then developed with a developer included in the developing unit to form a toner image on the photoreceptor 4.

The toner image on the photoreceptor 4 is transferred on a receiving material 18 (a transfer paper), which is timely fed to the transfer belt device 8 with a pair of registration rollers 16. The residual toner on the photoreceptor 4 is cleaned by a cleaning device 14.

The transfer belt device 8 includes an endless dielectric belt 20, and a bias roller 22 and a roller 24 which rotate the endless dielectric belt 20. In order to shorten the time during which the photoreceptor 4 faces the dielectric belt 20 with a micro gap therebetween, the bias roller 22 serves as a drive roller. At a point on the downstream side of the dielectric belt 20 in the moving direction of the dielectric belt 20, a bias roller 26 is provided. The bias roller 26 serves as a back-up roller which lengthens the width of the nip between the photoreceptor 4 and the dielectric belt 20. The bias rollers 22 and 26 rotate while contacting the dielectric belt 20, and are connected with respective transfer power sources.

In the entrance of the image transfer region, a guide member 32 is provided which forcibly guides the receiving material 18 to the image transfer region. The transfer material 18 is guided by the guide member 32 such that the receiving material 18 contacts the photoreceptor 4 at a point P1 which is positioned about 5 mm before a point P0 at which the photoreceptor 4 contacts the dielectric belt 20.

Therefore, the receiving material 18 is fed by the guide member 32 to the transfer region such that a toner scattering problem is hardly caused. When the receiving material 18 reaches the transfer region, the surface of the receiving material 18 is charged positive due to dielectric polarization, and electrostatically attracts the toner image which is charged negative.

Figure 2:
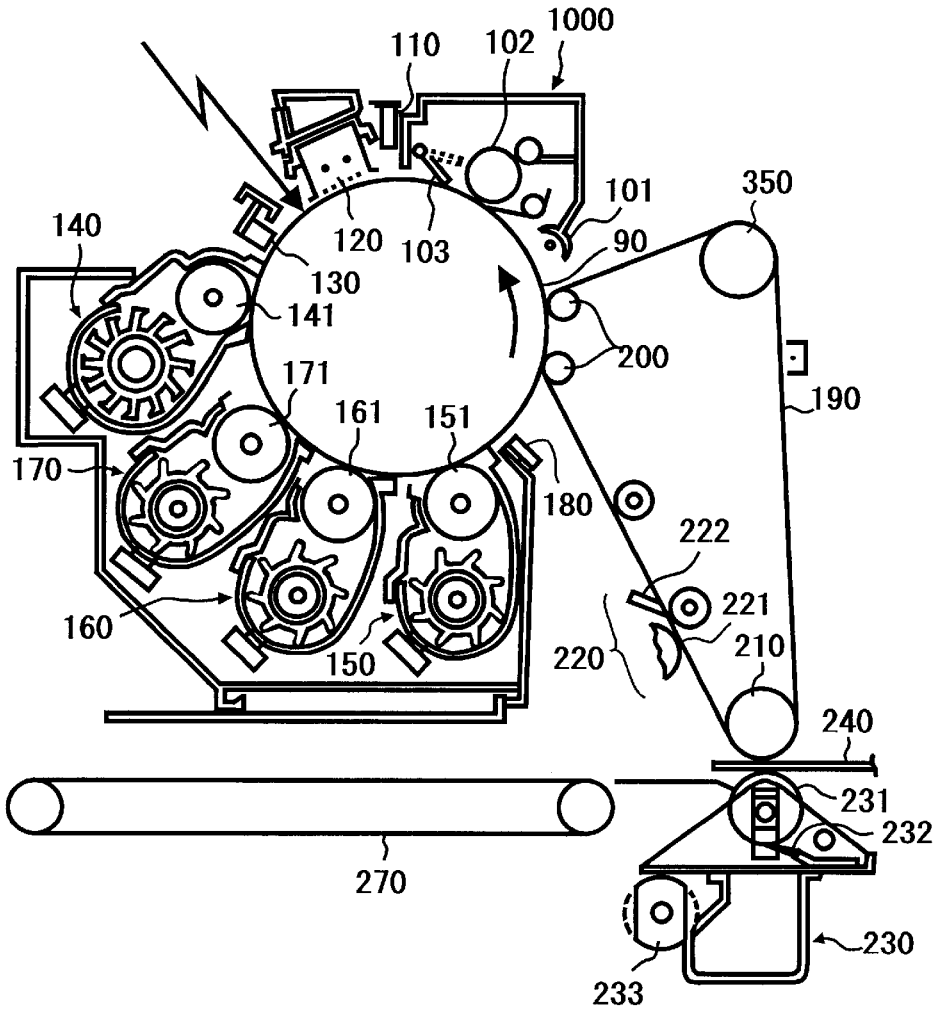
FIG. 2 is a schematic view illustrating the main part of another image forming apparatus for use in the electrophotographic image forming method of the present invention.

FIG. 2 is a schematic view illustrating a main part of the color image forming apparatus of the present invention.

In FIG. 2, a photoreceptor 90 rotates in the counterclockwise direction indicated by an arrow. Around the photoreceptor 90, a cleaning unit 1000 including a pre-cleaning discharger 101, cleaning roller 102 and a cleaning blade 103, a discharging lamp 110, a charger 120, a potential sensor 130, a Bk developing device 140 which develops an electrostatic latent image to form a black image, a C developing device 150 which develops an electrostatic latent image to form a cyan image, an M developing device 160 which develops an electrostatic latent image to form a magenta image, a Y developing device 170 which develops an electrostatic latent image to form a yellow image, a developing density detector 180, and an intermediate transfer belt 190 are provided. In each of the developing devices 140, 150, 160 and 170, a developing sleeve 141, 151, 161 or 171 is provided. The developing sleeve 141 (or 151, 161 or 171) rotates to feed a Bk (or C, M or Y) developer contained in the Bk (or C, M or Y) developing device 140 (or 150, 160 or 170) so as to face the photoreceptor 90. In addition, a developing paddle which rotates for agitating the toner, a toner concentration detector etc. are included in each of the developing devices 140, 150, 160 and 170. Hereinafter, the image forming method will be explained while assuming that developing operations are performed in the order of Bk, C, M and Y color. The order of the developing operations is not limited thereto.

The image forming method of the present invention will be explained in detail. An image of an original is read with a color scanner (not shown). The photoreceptor 90, which has been entirely charged, is exposed to imagewise laser light based on the black image data of the read original image. Thus an electrostatic latent image (hereinafter referred to as a Bk latent image) is formed on the photoreceptor. The developing sleeve 141 is rotated so as to be able to develop from the tip edge of the Bk latent image with a Bk developer (hereinafter referred to as a Bk toner). This Bk developing operation is continued until the end of the Bk latent image passes though the Bk developing area. After the end of the Bk latent image passes though the Bk developing area, the Bk developing device 140 is allowed to achieve a non-developing state so as not to develop other color (C, M or Y) latent images.

The developing operation may be performed by a posi-posi developing method or a nega-posi developing method (i.e, a reverse developing method).

Then the Bk toner image formed on the photoreceptor 90 is transferred onto the intermediate transfer belt 190 which rotates at the same speed as that of the photoreceptor 90. The transferring of toner images from the photoreceptor 90 to the intermediate transfer belt 190 is hereinafter referred to as a first image transfer. The first image transfer is performed while the photoreceptor 90 contacts the intermediate transfer belt 190 and a transfer bias voltage is applied to the intermediate transfer belt 190 and the photoreceptor 90. This first image transfer is repeated with respect to the other color (C, M and Y) toner images, which correspond to each of the color image data obtained by color-separating the original image, to form a full color toner image on the intermediate transfer belt 190. The full color image is then transferred onto a receiving paper (hereinafter referred to as a second image transfer). The intermediate transfer belt 190 will be explained later in detail.

Then the photoreceptor 90, which has finished to transfer the Bk toner images and is cleaned by the cleaning unit 1000, is again entirely charged and exposed to imagewise laser light based on the cyan image data of the original image. Thus a C latent image is formed on the photoreceptor. The developing sleeve 151 is rotated so as to be able to develop from the tip edge of the C latent image with a C developer (hereinafter referred to as a C toner). This C developing operation is continued until the end of the C latent image passes though the C developing area. After the end of the C latent image passes though the C developing area, the C developing device 150 is allowed to achieve a non-developing state so as not to develop other color (M or Y) latent images.

Then the first toner image transfer process is repeated with respect to the M toner image and Y toner image in this order to form a full color toner image on the intermediate transfer belt 190.

The intermediate transfer belt 190 is wound around bias rollers 20, a drive roller 210 and a driven roller 350. The rotation of the drive roller 200 is controlled by a drive motor (not shown). A belt cleaning unit 220 has a brush roller 221 in which about a half portion of a brush is exposed, a rubber blade 222 etc. The belt cleaning unit 220 is allowed to be attached to or detached from the intermediate transfer belt 190 by a attaching/detaching mechanism (not shown). The belt cleaning unit 220 is allowed to be detached from the_intermediate transfer belt 190 from the start of an image forming operation to the end of the first Y image transfer. When all the first image transfer processes are finished, the cleaning unit 220 is allowed to be attached to the intermediate transfer belt 190 at a predetermined time to clean the surface of the intermediate transfer belt 190 from which the full color toner image has been transferred onto a receiving paper 240.

An image transfer unit 230 has a transfer bias roller 231 (i.e., an electric field forming device for the secondary image transfer), a roller cleaning blade 232, a attaching/detaching device 233 which can attach/detach the transfer unit to/from the intermediate transfer belt 190, etc. The bias roller 231 is normally detached from the intermediate transfer belt 190. When the full color toner image formed on the intermediate transfer belt 190 is transferred onto the receiving paper 240, the bias roller 231 is timely attached to the intermediate transfer belt 190 by the attaching/detaching device 233 while a predetermined bias voltage is applied to the bias roller 231. Thus, the full color toner image is transferred onto the receiving paper 240. The receiving paper 240 on which the full color toner images are formed is then fed to a belt fixing device (not shown) by a paper feeding unit 270 to fix the full color toner image on the receiving paper 240. The fixing operation is performed according to the method mentioned above.

After each of the first image transfer operations are finished, the surface of the photoreceptor 90 is cleaned with the cleaning unit 1000 and then uniformly discharged with the discharging lamp 110.

As mentioned above, a full color image is formed on a receiving material by first transferring color toner images formed on the photoreceptor 90 to the intermediate transfer belt 190 one by one and then secondarily transferring the color toner images from the intermediate transfer belt 190 to the receiving paper 240 at once.

In the present embodiment, only one photoreceptor 90 is used. However, a plurality of photoreceptors may be used. For example, each of the photoreceptors may bear a Bk image, a C image, an M image and a Y image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed with a mixer.

| | |
|---|---|
| Binder resin (polyester resin having a melting point of 125.0° C.) | 100 |
| Colorant (carbon black) | 10 |
| Charge controlling agent (zinc salicylate) | 10 |
| Release agent | 5 |

(carnauba wax having a melting point of 82.5° C.)

In this case, the difference in solubility parameter between the binder resin and the release agent was 1.5.

The mixture was heated to 105° C. and kneaded with a kneader to prepare a mixture of the components. Then the mixture was subjected to a roll cooling treatment such that the temperature of the mixture was 57° C. just after the mixture was subjected to the roll cooling treatment. The interval between the time at which the mixture was discharged from the exit of the kneader and the time at which the mixture started to be subjected to the roll cooling treatment was 10 seconds. Thus a mother toner block was prepared. Then the mother toner block was crushed with a hammer mill. The crushed mixture was pulverized with a pulverizer using jet air and then the pulverized mixture was classified with an air classifier. Thus, a mother toner powder was prepared.

In addition, 100 parts of the thus prepared mother toner were mixed with 1 part of hydrophobic silica using a mixer. Thus, a toner of Example 1 was prepared.

Two and half (2.5) parts of the toner were mixed with 97.5 parts of a carrier which was coated with a silicone resin to prepare a two-component developer.

The toner and developer were evaluated by the following methods:

(1) Charge Quantity of Developer

The charge quantity of a developer was measured by a blow-off method. The unit of the charge quantity is $\mu$C/g. The charge quantity was also measured after the developer was subjected to a running test mentioned below in paragraph (4).

(2) Average Needle-shape Degree

The dissolving method mentioned above was used to determine the needle-shape degree of the release agent included in the mother toner. The needle-shape degree is defined as follows:

$$\text{Needle-shape degree}=LD/SD$$

wherein LD represents a diameter of a particle of the release agent dispersed in the toner in a major axis direction; and SD represents a diameter of the particle in a minor axis direction.

Several particles of the release agent were observed to determine an average needle-shape degree.

(3) Equivalent Spherical Particle Diameter

The images of the release agent dispersed in the mother toner block obtained in paragraph (2) were subjected to an image processing treatment to determine the equivalent spherical particle diameter of the release agent.

As mentioned above, the equivalent spherical particle diameter of the release agent is determined as the diameter of a circle having the same area as the ellipsoid of the particulate release observed by an optical microscope. Several particles of the release agent were observed to determine an average equivalent spherical particle diameter.

(4) Image Qualities

The developer was set in a copier, PRETER 550 manufactured by Ricoh Co., Ltd. A running test in which 10,000 images were continuously produced. The images were evaluated with respect to the following image qualities.

(A) Offset Resistance

The produced images were visually observed to determine whether the images had an offset image thereon.

(B) Image Density and Background Density

The image density and background density of the images were measured with a Macbeth reflection densitometer before and after the running test.

(C) Image Omission

The produced images were visually observed with eyes and a loupe to determine whether the images had omissions therein. The images were classified into the following five grades:

Rank 5: The images have no omission.

Rank 4: Omissions cannot be found by human eyes but one or two small omissions are found when observed using a loupe.

Rank 3: Omissions are hardly found by human eyes but several small omissions are found when observed using a loupe.

Rank 2: Small omissions are found by human eyes.

Rank 1: Large omissions are found by human eyes.

Example 2

The procedure for preparation of the toner in Example 1 was repeated except that the temperature in the kneading process was 100° C. and the temperature of the toner mixture was 55° C. just after the mixture was subjected to the roll cooling treatment. Thus a toner of Example 2 was prepared.

In addition, a developer was prepared in the same way as performed in Example 1.

Further the toner and the developer were evaluated in the same way as performed in Example 1.

Example 3

The procedure for preparation of the toner in Example 1 was repeated except that the temperature in the kneading process was 95° C. and the temperature of the toner mixture was 52° C. just after the mixture was subjected to the roll cooling treatment. Thus a toner of Example 3 was prepared.

In addition, a developer was prepared in the same way as performed in Example 1.

Further the toner and the developer were evaluated in the same way as performed in Example 1.

Example 4

The procedure for preparation of the toner in Example 1 was repeated except that the temperature in the kneading process was 90° C. and the temperature of the toner mixture was 50° C. just after the mixture was subjected to the roll cooling treatment. Thus a toner of Example 4 was prepared.

In addition, a developer was prepared in the same way as performed in Example 1.

Further the toner and the developer were evaluated in the same way as performed in Example 1.

Example 5

The following components were mixed with a mixer.

| | |
|---|---|
| Binder resin | 100 |
| (polyester resin having a melting point of 125.0° C.) | |
| Colorant (carbon black) | 10 |
| Charge controlling agent (zinc salicylate) | 10 |
| Release agent | 5 |

(Low Molecular Polyethylene Having a Melting Point of 84.5° C.)

In this case, the difference in solubility parameter between the binder resin and the release agent was 2.5.

The mixture was heated to 90° C. and kneaded with a kneader to prepare a mixture of the components. Then the mixture was subjected to a roll cooling treatment such that the temperature of the mixture was 50° C. just after the mixture was subjected to the roll cooling treatment. The interval between the time at which the mixture was discharged from the exit of the kneader and the time at which the mixture started to be subjected to the roll cooling treatment was 10 seconds. Thus a mother toner block was prepared. Then the mother toner block was crushed with a hammer mill. The crushed mixture was pulverized with a pulverizer using jet air and then the pulverized mixture was classified with an air classifier. Thus, a mother toner powder was prepared.

In addition, 100 parts of the thus prepared mother toner were mixed with 1 part of the hydrophobic silica used in Example 1 using a mixer. Thus, a toner of Example 5 was prepared.

Two and half (2.5) parts of the toner were mixed with 97.5 parts of the carrier used in Example 1 to prepare a two-component developer.

The toner and developer were evaluated by the methods mentioned above.

Example 6

The following components were mixed with a mixer.

| | |
|---|---|
| Binder resin | 100 |
| (polyester resin having a melting point of 125.0 ° C.) | |
| Colorant (carbon black) | 10 |
| Charge controlling agent (zinc salicylate) | 10 |
| Release agent 1 | 3 |
| (carnauba wax having a melting point of 82.5° C.) | |
| Release agent 2 | 2 |

(Low Molecular Polyethylene Having a Melting Point of 84.5° C.)

In this case, the difference in solubility parameter between the binder resin and the release agent 1 was 1.5 and the difference in solubility parameter between the binder resin and the release agent 2 was 2.5.

The mixture was heated to 90° C. and kneaded with a kneader to prepare a mixture of the components. Then the mixture was subjected to a roll cooling treatment such that the temperature of the mixture was 50° C. just after the mixture was subjected to the roll cooling treatment. The interval between the time at which the mixture was discharged from the exit of the kneader and the time at which the mixture started to be subjected to the roll cooling treatment was 10 seconds. Thus a mother toner block was prepared. Then the mother toner block was crushed with a hammer mill. The crushed mixture was pulverized with a pulverizer using jet air and then the pulverized mixture was classified with an air classifier. Thus, a mother toner powder was prepared.

In addition, 100 parts of the thus prepared mother toner were mixed with 1 part of the hydrophobic silica used in Example 1 using a mixer. Thus, a toner of Example 6 was prepared.

Two and half (2.5) parts of the toner were mixed with 97.5 parts of the carrier used in Example 1 to prepare a two-component developer.

The toner and developer were evaluated by the methods mentioned above.

Example 7

The procedure for preparation of the toner in Example 1 was repeated except that the kneading-temperature was 90° C., the temperature of the toner mixture was 40° C. just after the mixture was subjected to the roll cooling treatment, and the interval between the time at which the mixture was discharged from the exit of the kneader and the time at which the mixture started to be subjected to the roll cooling treatment was 30 seconds. Thus, a toner of Example 7 was prepared.

In addition, a developer was prepared in the same way as performed in Example 1.

Further the toner and the developer were evaluated in the same way as performed in Example 1.

Example 8

The procedure for preparation of the toner in Example 1 was repeated except that the kneading temperature was 90° C., the temperature of the toner mixture was 30° C. just after the mixture was subjected to the roll cooling treatment, and the interval between the time at which the mixture was discharged from the exit of the kneader and the time at which the mixture started to be subjected to the roll cooling treatment was 58 seconds. Thus, a toner of Example 8 was prepared.

In addition, a developer was prepared in the same way as performed in Example 1.

Further the toner and the developer were evaluated in the same way as performed in Example 1.

Example 9

The procedure for preparation of the toner in Example 1 was repeated except that the kneading temperature was 90° C., the temperature of the toner mixture was 60° C. just after the mixture was subjected to the roll cooling treatment, and the interval between the time at which the mixture was discharged from the exit of the kneader and the time at which the mixture started to be subjected to the roll cooling treatment was 5 seconds. Thus, a toner of Example 9 was prepared.

In addition, a developer was prepared in the same way as performed in Example 1.

Further the toner and the developer were evaluated in the same way as performed in Example 1.

Comparative Example 1

The procedure for preparation of the toner in Example 1 was repeated except that the kneading temperature was 140° C., and the temperature of the toner mixture was 70° C. just after the mixture was subjected to the roll cooling treatment. Thus, a toner of Comparative Example 1 was prepared.

In addition, a developer was prepared in the same way as performed in Example 1.

Further the toner and the developer were evaluated in the same way as performed in Example 1.

Comparative Example 2

The procedure for preparation of the toner in Example 1 was repeated except that the kneading temperature was 140° C., and the kneaded mixture was naturally cooled without being subjected to the roll cooling treatment. Thus, a toner of Comparative Example 2 was prepared.

In addition, a developer was prepared in the same way as performed in Example 1.

Further the toner and the developer were evaluated in the same way as performed in Example 1.

Comparative Example 3

The procedure for preparation of the toner in Example 1 was repeated except that the kneading temperature was 100° C., and the kneaded mixture was naturally cooled without being subjected to the roll cooling treatment. Thus, a toner of Comparative Example 3 was prepared.

In addition, a developer was prepared in the same way as performed in Example 1.

Further the toner and the developer were evaluated in the same way as performed in Example 1.

Comparative Example 4

The following components were mixed with a mixer.

| | |
|---|---|
| Binder resin (polyester resin having a melting point of 125.0° C.) | 100 |
| Colorant (carbon black) | 10 |
| Charge controlling agent (zinc salicylate) | 10 |
| Release agent | 5 |

(alkylphosphoric acid ester having a melting point of 78.5° C.)

In this case, the difference in solubility parameter between the binder resin and the release agent was 0.6.

The mixture was heated to 90° C. and kneaded with a kneader to prepare a mixture of the components. Then the mixture was subjected to a roll cooling treatment such that the temperature of the mixture was 50° C. just after the mixture was subjected to the roll cooling treatment. The time difference between the time at which the mixture was discharged from the exit of the kneader and the time at which the mixture started to be subjected to the roll cooling treatment was 10 seconds. Thus a mother toner block was prepared. Then the mother toner block was crushed with a hammer mill. The crushed mixture was pulverized with a pulverizer using jet air and then the pulverized mixture was classified with an air classifier. Thus, a mother toner powder was prepared.

In addition, 100 parts of the thus prepared mother toner were mixed with 1 part of the hydrophobic silica used in Example 1 using a mixer Thus, a toner of comparative Example 6 was prepared.

Two and half (2.5) parts of the toner were mixed with 97.5 parts of the carrier used in Example 1 to prepare a two-component developer.

The toner and developer were evaluated by the methods mentioned above.

Comparative Example 5

The procedure for preparation of-the toner in Example 1 was repeated except that the kneading temperature was 90° C., the temperature of the toner mixture was 40° C. just after the mixture was subjected to the roll cooling treatment, and the difference between the time at which the mixture was discharged from the exit of the kneader and the time at which the mixture started to be subjected to the roll cooling treatment was 120 seconds. Thus, a toner of Comparative Example 5 was prepared.

In addition, a developer-was prepared in the same way as performed in Example 1.

Further the toner and the developer were evaluated in the same way as performed in Example 1.

Comparative Example 6

The procedure for preparation of the toner in Example 1 was repeated except that the kneading temperature was 140° C., and the temperature of the toner mixture was 85° C. just after the mixture was subjected to the roll cooling treatment. Thus, a toner of Comparative Example 6 was prepared.

In addition, a developer was prepared in the same way as performed in Example 1.

Further the toner and the developer were evaluated in the same way as performed in Example 1.

The results are shown in Tables 1 and 2.

TABLE 1

| | Average needle shape degree | Average sphere-equiv. Particle diameter | Initial charge quantity (−μC/g) | Initial image qualities | | | |
|---|---|---|---|---|---|---|---|
| | | | | Offset Resist. | Image density | Back-ground density | Omis-sion |
| Ex. 1 | 1.8 | 1.2 | 22.5 | Good | 1.5 | 0.07 | 5 |
| Ex. 2 | 3.5 | 1.2 | 22.1 | Good | 1.5 | 0.07 | 5 |
| Ex. 3 | 10.0 | 1.2 | 21.9 | Good | 1.5 | 0.07 | 5 |

TABLE 1-continued

| | Average needle shape degree | Average sphere-equiv. Particle diameter | Initial charge quantity (−μC/g) | Initial image qualities: Offset Resist. | Image density | Back-ground density | Omis-sion |
|---|---|---|---|---|---|---|---|
| Ex. 4 | 12.0 | 0.5 | 21.6 | Good | 1.5 | 0.07 | 5 |
| Ex. 5 | 10.0 | 1.2 | 22.0 | Good | 1.5 | 0.07 | 5 |
| Ex. 6 | 5.0*<br>10.0** | 0.5<br>1.0 | 22.2 | Excellent | 1.5 | 0.07 | 5 |
| Ex. 7 | 9.0 | 0.5 | 22.8 | Good | 1.5 | 0.07 | 5 |
| Ex. 8 | 8.0 | 0.6 | 23.0 | Good | 1.5 | 0.07 | 5 |
| Ex. 9 | 12.0 | 0.5 | 21.0 | Good | 1.5 | 0.07 | 5 |
| Comp. Ex. 1 | 1.2 | 2.0 | 25.2 | Good | 1.5 | 0.07 | 4 |
| Comp. Ex. 2 | 1.1 | 4.0 | 26.3 | Good | 1.5 | 0.07 | 4 |
| Comp. Ex. 3 | 1.1 | 3.0 | 22.5 | Good | 1.5 | 0.07 | 4 |
| Comp. Ex. 4 | Cannot be measured*3 | — | 22.3 | Bad | 1.7 | 0.07 | 5 |
| Comp. Ex. 5 | 1.5 | 1.5 | 23.2 | Good | 1.5 | 0.07 | 4 |
| Comp. Ex. 6 | 1.5 | 1.5 | 23.2 | Good | 1.5 | 0.07 | 4 |

*: the needle-shape degree of release agent 1 (carnauba wax)
**: the needle-shape degree of release agent 2 (low molecular polyethylene)
*3: the release agent was dissolved in the binder resin and therefore the particle diameter could not be measured.

TABLE 2

| | Charge quantity after running test (μC/g) | Change of charge quantity*4 | Image qualities after running test: Image density | Back-ground density | Omission |
|---|---|---|---|---|---|
| Ex. 1 | 17.2 | ○ | 1.4 | 0.08 | 4.5 |
| Ex. 2 | 19.5 | ○ | 1.5 | 0.08 | 5 |
| Ex. 3 | 20.2 | ○ | 1.5 | 0.08 | 5 |
| Ex. 4 | 21.5 | ○ | 1.5 | 0.08 | 5 |
| Ex. 5 | 20.4 | ○ | 1.5 | 0.08 | 5 |
| Ex. 6 | 21.8 | ○ | 1.5 | 0.08 | 5 |
| Ex. 7 | 21.1 | ○ | 1.5 | 0.08 | 5 |
| Ex. 8 | 21.2 | ○ | 1.5 | 0.08 | 5 |
| Ex. 9 | 21.0 | ○ | 1.5 | 0.08 | 5 |
| Comp Ex. 1 | 15.3 | × | 1.3 | 0.12 | 3 |
| Comp. Ex. 2 | 9.9 | × | 1.2 | 0.17 | 2 |
| Comp. Ex. 3 | 12.1 | × | 1.3 | 0.09 | 2 |
| Comp. Ex. 4 | 21.1 | ○ | 1.7 | 0.08 | 5 |
| Comp. Ex. 5 | 16.6 | Δ | 1.3 | 0.12 | 4 |
| Comp. Ex. 6 | 16.4 | Δ | 1.3 | 0.12 | 4 |

*4 ○ : Change of the charge quantity before and after the running test is little.
Δ: The charge quantity after the running test is slightly decreased.
×: The charge quantity after the running test is largely decreased.

As can be understood from Tables 1 and 2, the toner of the present invention which has a needle-shape degree not less than 1.6 can maintain good charge property, and produce good images without causing undesired images such as offset images, background development and image omissions, even when repeatedly used for a long period of time.

This document claims priority and contains subject matter related to Japanese Patent Application No. 11-323225, filed on Nov. 12, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising toner particles, which toner particles comprise a binder resin having a first melting point and a first solubility parameter, a colorant, and a first particulate release agent, said first particulate release agent having a second melting point lower than the first melting point and a second solubility parameter different from the first solubility parameter, wherein the first particulate release agent has an average needle-shape degree LD/SD of not less than 1.6, where LD is a diameter of a particle of the first release agent dispersed in the toner in a major axis direction thereof and SD is a diameter of the particle in a minor axis direction.

2. The toner according to claim 1, wherein 75% by number or more of the first particulate release agent in the toner particles has a needle-shape degree of not less than 2.0.

3. The toner according to claim 1, wherein 75% by number or more of the first particulate release agent in the toner particles has an equivalent spherical particle diameter of not greater than 1.0 μm.

4. The toner according to claim 1, wherein the second melting point is from 65 to 100° C., and a difference between the first solubility parameter and second solubility parameter is not less than 1.0.

5. The toner according to claim 4, wherein the first particulate release agent is present in the toner in an amount of from 1 to 10% by weight.

6. The toner according to claim 1, wherein the toner particles further comprises a second particulate release agent having a third melting point and a third solubility parameter, and wherein the third melting point is lower than the first melting point and different from the second melting point, and the third solubility parameter is different from the first and second solubility parameters.

7. The toner according to claim 1, wherein the toner is manufactured by a method comprising a kneading step in which the binder resin, colorant, and first release agent are kneaded at a temperature not higher than a temperature higher than the first melting point by 20° C. and higher than the second melting point using a kneader.

8. The toner according to claim 7, wherein the method further comprises a cooling step which follows the kneading step and in which the binder resin, colorant, and first release agent are subjected to a cooling treatment so as to be cooled to a temperature lower than the second melting point, and wherein an interval between a time at which the binder resin, colorant and first releasing agent are discharged from the kneader and a time at which the cooling step starts is not longer than 60 seconds.

9. The toner as claimed in claim 1, wherein said average needle-shaped degree is from 3–10.

10. An image forming method comprising:

forming a toner image on an image bearing member; and transferring the toner image onto a receiving material, wherein the toner comprises toner particles, which toner particles comprise a binder resin having a first melting point and a first solubility parameter, a colorant, and a first particulate release agent, said first particulate release agent having a second melting point lower than the first melting point and a second solubility parameter different from the first solubility parameter, wherein the first particulate release agent has an average needle-shape degree LD/SD of not less than 1.6, where LD is a diameter of a particle of the first release agent dispersed in the toner in a major axis direction thereof and SD is a diameter of the particle in a minor axis direction.

11. The image forming method according to claim 10, wherein 75% by number or more of the first particulate release agent in the toner particles has a needle-shape degree of not less than 2.0.

12. The image forming method according to claim 10, wherein 75% by number or more of the first particulate release agent in the toner particles has an equivalent spherical particle diameter of not greater than 1.0 $\mu$m.

13. The image forming method according to claim 10, wherein the second melting point is from 65 to 100° C., and a difference between the first solubility parameter and second solubility parameter is not less than 1.0.

14. The image forming method according to claim 13, wherein the first particulate release agent is present in the toner in an amount of from 1 to 10% by weight.

15. The image forming method according to claim 10, wherein the toner particles further comprises a second particulate release agent having a third melting point and a third solubility parameter, and wherein the third melting point is lower than the first melting point and different from the second melting point, and the third solubility parameter is different from the first and second solubility parameters.

16. The image forming method as claimed in claim 10, wherein said average needle-shaped degree is from 3–10.

17. A color image forming method comprising:

forming a toner image on an image bearing member with a color toner selected from the group consisting of a yellow toner, a magenta toner, a cyan toner and a black toner to form an image;

transferring the image onto a transfer material to form the toner image thereon; and optionally repeating said toner image forming and transferring one or more times using one or more of the other toners to form a color image on the intermediate transfer medium, wherein said yellow toner, magenta toner, cyan toner and black toner comprise toner particles, which toner particles comprise a binder resin having a first melting point and a first solubility parameter, a colorant, and a first particulate release agent, said first particulate release agent having a second melting point lower than the first melting point and a second solubility parameter different from the first solubility parameter, wherein the first particulate release agent has an average needle-shape degree LD/SD of not less than 1.6, where LD is a diameter of a particle of the first release agent dispersed in the toner in a major axis direction thereof and SD is a diameter of the particle in a minor axis direction.

18. The color image forming method according to claim 17, wherein 75% by number or more of each of the first particulate release agents in the respective toner particles has a needle-shape degree of not less than 2.0.

19. The color image forming method according to claim 17, wherein 75% by number or more of each of the first particulate release agents in the respective toner particles has an equivalent spherical particle diameter of not greater than 1.0 $\mu$m.

20. The color image forming method according to claim 17, wherein the second melting point is from 65 to 100° C., and a difference between the first solubility parameter and second solubility parameter is not less than 1.0.

21. The color image forming method according to claim 20, wherein each of the first particulate release agents is present in the respective toner particles in an amount of from 1 to 10% by weight.

22. The color image forming method according to claim 17, wherein each of the toner particles further comprises a second particulate release agent having a third melting point and a third solubility parameter, and wherein the third melting point is lower than the first melting point and different from the second melting point, and the third solubility parameter is different from the first and second solubility parameters.

23. The color image forming method of claim 17, wherein said average needle-shaped degree is from 3–10.

24. A method for manufacturing a toner comprising:

kneading a mixture of a binder resin having a first melting point and a first solubility parameter, a colorant, and a first release agent having a second melting point lower than the first melting point and a second solubility parameter different from the first solubility parameter at a temperature not higher than a temperature higher than the first melting point by 20° C. and higher than the second melting point to prepare a kneaded mixture;

subjecting the kneaded mixture to a cooling treatment to prepare a mother toner block;

pulverizing the mother toner block;

classifying the pulverized mother toner block to prepare a mother toner; and optionally adding an external additive to the mother toner to prepare a toner.

25. The method according to claim 24, wherein an interval between the kneading step and the cooling step is not longer than 60 seconds.

26. The method according to claim 24, wherein the first release agent in the toner has an average needle-shape degree LD/SD of not less than 1.6, where LD is a diameter of a particle of the first release agent dispersed in the toner in a major axis direction thereof and SD is a diameter of the particle in a minor axis direction.

27. The method as claimed in claim 26, wherein said average needle-shaped degree is from 3–10.

28. The method according to claim 24, wherein 75% by number or more of the first release agent in the toner has a needle-shape degree of not less than 2.0.

29. The method according to claim 24, wherein 75% by number or more of the first release agent in the toner has an equivalent spherical particle diameter of not greater than 1.0 $\mu$m.

30. The method according to claim 24, wherein the second melting point is from 65 to 100° C., and a difference between the first solubility parameter and second solubility parameter is not less than 1.0.

31. The method according to claim 30, wherein each of the first release agent is present in the toner in an amount of from 1 to 10% by weight.

32. The method according to claim 24, wherein the mixture further comprises a second release agent having a third melting point and a third solubility parameter, and wherein the third melting point is lower than the first melting point and different from the second melting point, and the third solubility parameter is different from the first and second solubility parameters.

33. A printed toner image comprising fixed toner wherein said toner comprises toner particles, which toner particles comprise a binder resin having a first melting point and a first solubility parameter, a colorant, and a first particulate release agent, said first particulate release agent having a second melting point lower than the first melting point and a second solubility parameter different from the first solubility parameter, wherein the first particulate release agent has an average needle-shape degree LD/SD of not less than 1.6, where LD is a diameter of a-particle of the first release agent dispersed in the toner in a major axis direction thereof and SD is a diameter of the particle in a minor axis direction, prior to fixing.

34. The printed toner image as claimed in claim 33, wherein said average needle-shaped degree is from 3–10.

* * * * *